United States Patent [19]

Kobayashi

[11] Patent Number: 4,819,939

[45] Date of Patent: Apr. 11, 1989

[54] GRIP FOR A GOLF CLUB SHAFT

[75] Inventor: Masashi Kobayashi, Matsudo, Japan

[73] Assignee: Maruman Golf Co., Ltd., Tokyo, Japan

[21] Appl. No.: 924,000

[22] Filed: Oct. 28, 1986

[30] Foreign Application Priority Data

Oct. 30, 1985 [JP] Japan ..... 60-241578
Jan. 25, 1986 [JP] Japan ..... 61-12981

[51] Int. Cl.[4] ..... A63B 49/08

[52] U.S. Cl. ..... 273/81 R; 273/81.2; 273/75

[58] Field of Search ..... 273/81.2, 81.3, 81.4, 273/81.6, 81 R, 165, 166, 75

[56] References Cited

U.S. PATENT DOCUMENTS

| | | | |
|---|---|---|---|
| 399,340 | 3/1889 | Morgan | 273/75 |
| 1,139,843 | 5/1915 | Brown | 273/81.6 |
| 1,330,791 | 2/1920 | Dickey | 273/81 R |
| 1,441,986 | 1/1923 | Lard | 273/81.6 |
| 2,117,129 | 5/1938 | Young | 273/81 R |
| 2,133,695 | 10/1938 | Hall | 273/81 R |
| 2,318,682 | 5/1943 | Fawick | 273/81 R |
| 2,941,806 | 6/1960 | Stevens | 273/81.2 |
| 3,016,763 | 1/1962 | Albert | 273/81 R |
| 3,530,739 | 9/1970 | Meier | 273/81 R |
| 3,606,325 | 9/1971 | Lamkin et al. | 273/81 R |
| 3,606,326 | 9/1971 | Sparks et al. | 273/81 R |
| 3,674,267 | 7/1972 | Hollis | 273/75 |
| 3,802,291 | 4/1974 | Young et al. | 273/81 R |
| 4,098,506 | 7/1978 | Gaiser | 273/81 R |

FOREIGN PATENT DOCUMENTS

| | | | |
|---|---|---|---|
| 721627 | 11/1965 | Canada | 273/81.5 |
| 1142073 | 2/1969 | United Kingdom | 273/75 |

*Primary Examiner*—Thomas F. Callaghan
*Assistant Examiner*—Peter M. Cuomo
*Attorney, Agent, or Firm*—Armstrong, Nikaido, Marmelstein & Kubovcik

[57] ABSTRACT

A double-layered tubular grip (13) for a golf club shaft, comprises a tubular inner layer (14) made of a porous material secured to the outer surface of the butt end portion of the shaft (11). A tubular outer layer (15) made of a non-porous material having an elasticity greater than that of the inner layer (14) is formed separately from the inner layer (14). The outer layer (15) is pushed over the inner layer (14) and detachably fixed thereto after the inner layer (14) is secured to the outer surface of the golf club shaft (11).

11 Claims, 4 Drawing Sheets

GRIP FOR A GOLF CLUB SHAFT

BACKGROUND OF THE INVENTION

1. Field of the Invention

The present invention relates to a grip for a golf club shaft, and more particularly, to an improvement of a double-layered tubular grip for a golf club shaft.

2. Description of the Related Art

Many kinds of tubular grips for golf club shafts have been known; a typical of one such grip being a single-layered vulcanized rubber grip made of one piece of non-porous, vulcanized rubber. Such a single-layered vulcanized rubber grip has a relatively heavy weight, for example, 45 to 50 g is usual, and thus has a drawback in that, when the grip is mounted on a golf club shaft, the weight of the golf club is increased, and accordingly, it becomes difficult to increase the speed of a head of the golf club during a swing motion thereof.

A single-layered foam rubber grip also has been used. The single-layered foam rubber grip has a relatively light weight, for example, 25 to 30 g is usual, due to the porous structure thereof, and thus can eliminate the above-mentioned drawback. Nevertheless, the single-layered foam rubber grip has a drawback in that the surface thereof having, usually, a plurality of grooves is easily worn by long term use, and thus a player's hands easily slip on the grip.

Japanese Unexamined Utility Model Publication No. 53-12061 discloses a double-layered tubular grip for a golf club shaft. Such a known double-layered tubular grip comprises an inner layer made of a porous material having a rubber-like elasticity, and a non-porous outer layer made of a vulcanized rubber. This known double-layered tubular grip has a weight less than that of the above-mentioned single-layered vulcanized rubber grip, and the wear of the surface of the grip is reduced due to the existence of non-porous outer layer. In this known double-layered tubular grip, however, the outer layer is undetachably secured to the inner layer, and thus it is impossible to change only the outer layer while leaving the inner layer on the golf club shaft.

This raises a problem in that, although the wear on the surface of the grip is reduced, nevertheless, after a long period of use, the grip surface becomes slippery, and thus should be changed. However, as mentioned above, it is impossible to change only the outer grip layer.

SUMMARY OF THE INVENTION

Accordingly, it is an object of the present invention to provide a tubular grip for a golf club shaft comprising a porous inner layer and a non-porous outer layer in which the outer layer can be easily detached from the inner layer, and thus only the outer layer of the grip can be easily changed while leaving the inner layer thereof on the golf club shaft.

The object of the present invention can be achieved by the provision of a double-layered tubular grip for a golf club shaft, comprising a tubular inner layer made of a porous material secured to the outer circumferential surface of the butt end portion of the shaft, and a tubular outer layer made of a non-porous material having an elasticity greater than that of the inner layer and formed separately from the inner layer; the tubular outer layer being detachably fixed to the inner layer after the inner layer is secured to the outer surface of the shaft.

In the grip according to the present invention, the tubular outer layer can be easily detached from the inner layer. Therefore, it is possible to change only the tubular outer layer of the grip while leaving the inner layer thereof on the golf club shaft, and thus a grip-change can be effected economically, when, for example, the outer surface of the tubular layer thereof becomes worn.

Preferably, a plurality of cavities are positively formed between the inner layer and the outer layer of the grip according to the present invention. According to this construction of the grip, it becomes possible to further reduce the weight of the grip and to improve the grip by giving it a softer feeling, due to the existence of the positive cavities. Further, it becomes possible to obtain a tighter grip on the golf club shaft, and thus stabilize the swing of the golf club, because portions of the outer surface of the grip corresponding to the positions of the cavities are easily depressed by the gripping force to provide a sure-grip surface.

BRIEF DESCRIPTION OF THE DRAWINGS

The foregoing and other objects and advantages of the present invention will become apparent from the following description with reference to the attached drawings; wherein.

DESCRIPTION OF THE PREFERRED EMBODIMENTS

Figure 1:
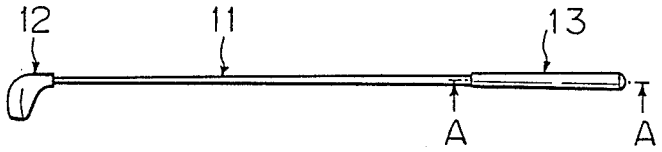
FIG. 1 is a side view of the golf club having a grip mounted on a club shaft, according to a first embodiment of the present invention.
Figure 2:
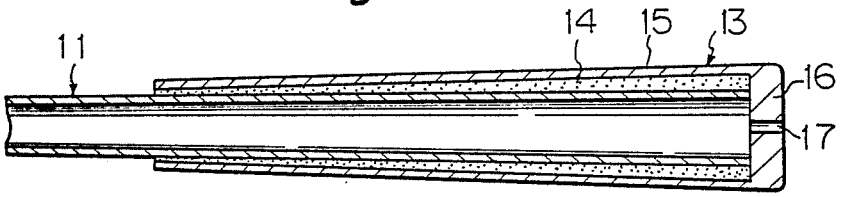
FIG. 2 is an enlarged cross-sectional view of the golf club taken along the line A—A in FIG. 1.

FIGS. 1 and 2 show a first embodiment of the present invention. Referring to FIG. 1, a club shaft 11 is provided with a head 12 attached to the tip end thereof, and with a tubular grip 13 mounted on the butt end thereof. Usually, the club shaft 11 is hollow and tapered from the butt end toward the tip end thereof. As shown in FIG. 2, the grip 13 comprises a tubular inner layer 14 surrounding the outer circumferential surface of the butt end portion of the club shaft 11 and secured thereto, and a tubular outer layer 15 surrounding an outer circumferential surface of the inner layer 14 and detachably fixed thereto. The butt end of the tubular outer layer 15 is formed integrally with a bottom wall 16 having a central hole 17. The inner layer 14 of the grip 13 is made of a porous material, such as foam urethane, foam rubber, cork, or the like, and the outer layer 15 is made of a non-porous elastic material, such as vulcanized natural rubber. The outer layer 15 has an elasticity greater than that of the inner layer 14.

In this embodiment, the thickness of the inner layer 14 increases continuously from the tip end to the butt end thereof, and the tubular outer layer 15 has a substantially uniform thickness and an outer diameter which increases continuously from the tip end toward the butt end thereof, as shown in FIG. 2. Preferably, the outer circumferential surface of the outer layer 15 of the grip 13 is formed with a plurality of grooves.

Figure 5:
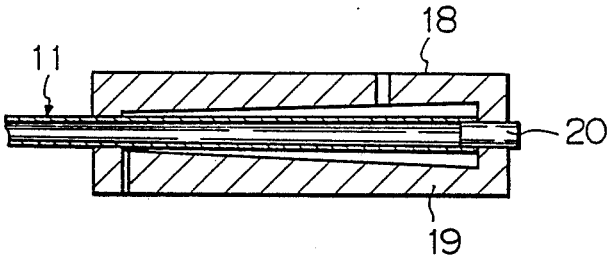
FIG. 5 is a cross-sectional view illustrating a process for forming an inner layer for the grip shown in FIG. 2, on the club shaft.
Figure 6:
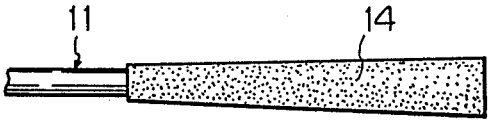
FIG. 6 is a view of an inner layer formed on the club shaft by means of the process shown in FIG. 5.
Figure 7:
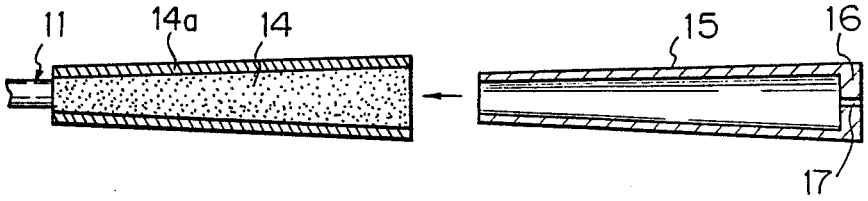
FIG. 7 is a view illustrating a process of fitting the tubular outer layer over the inner layer shown in FIG. 6 for the grip shown in FIG. 2.

FIGS. 5 to 7 illustrate a method of producing the above-described grip 13, as an example. FIG. 5 illustrates a process for forming an inner layer on the outer circumferential surface of the club shaft 11. In FIG. 5, the butt end portion of the shaft 11 is arranged between a pair of molds 18 and 19 which define therewithin a cavity for defining an outer surface of an inner layer to be formed on the shaft 11. A plug 20 is fitted into the butt end of the shaft 11 and supported between the molds 18 and 19, to stabilize the shaft 11 against the molds 18 and 19.

A raw material for the inner layer, such as urethane or rubber, is then fed into the cavity of the molds 18 and 19 through holes formed therein. The raw material in the molds 18 and 19 is then subject to a foaming by a conventional method, during a molding process. As a result, a porous inner layer 14 for the grip 13 shown in FIG. 2 is formed on the shaft 11 and secured thereto, as shown in FIG. 6. Since the inner layer 14 for the grip 13 is directly molded onto the shaft 11, as described above, it is unnecessary to provide a special core for defining the inner surface of the inner layer 14 during the molding. The outer surface of the shaft 11 may be formed with projections or grooves for preventing movement of the molded inner layer 14 along the outer circumferential surface of the shaft 11.

The tubular outer layer 15 for the grip 13 shown in FIG. 2 is made separately from the inner layer 14, by molding as shown in FIG. 7. Then, the open end of the outer layer 15 is expanded radially, and the outer layer 15 is then pushed over the inner layer 14 formed on the shaft 11 and is detachably fixed thereto by, for example, a conventional double-face adhesive tape or exfoliative adhesive 14*a*, provided on the outer circumferential surface of the inner layer 14 before the outer layer 15 is pushed over the inner layer 14.

The above-mentioned double-layered grip 13 includes a porous inner layer 14, and thus has less weight than that of the conventional single-layered non-foam rubber grip. Therefore, the golf club having the above-mentioned double-layered grip 13 can be easily swung, and the speed of the head of the golf club during the swing motion can be increased. Further, since outer layer 15 of the above-mentioned double-layered grip 13 is detachably fixed to the inner layer 14 thereof, it is possible to change only the outer layer 15 while leaving the inner layer 14 on the shaft 11.

Figure 3:
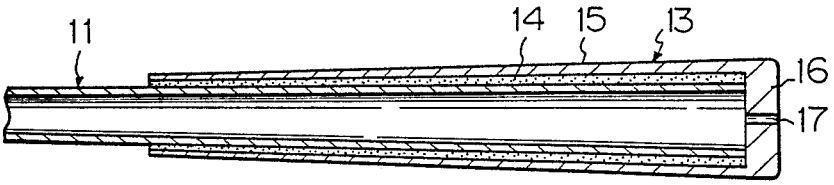
FIG. 3 is a cross-sectional view, similar to FIG. 2, of the golf club having a grip mounted on a club shaft according to a second embodiment of the present invention.
Figure 4:
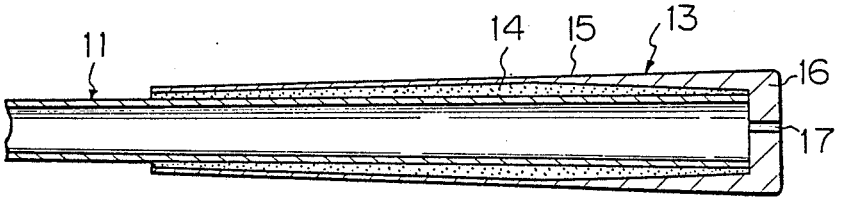
FIG. 4 is a cross-sectional view, similar to FIG. 2, of the golf club having a grip mounted on a club shaft according to a third embodiment of the present invention.

FIGS. 3 and 4 show second and third embodiments of the present invention, respectively. In these Figures, constitutional elements the same as in the above-mentioned embodiment bear the same reference numerals.

In the second embodiment shown in FIG. 3, a porous inner layer 14 of the double-layered grip 13 has an outer diameter which increases from the tip end to the middle thereof and is kept constant from the middle to the butt end thereof, while the outer diameter of a non-porous outer layer 15 increases gradually from the tip end to the butt end thereof, respectively. In the third embodiment shown in FIG. 4, a porous inner layer 14 of the double-layered grip 13 has an outer diameter which increases gradually from the tip end to the middle thereof, and decreases from the middle to the butt end thereof. On the other hand, the non-porous outer layer 15 of the double-layered grip 13 shown in FIG. 4 has an outer diameter which increases gradually from the tip end to the butt end thereof and has a thickness which is substantially constant from the tip end to the middle thereof and increases from the middle to the butt end thereof, to ensure a close fit with the outer circumferential surface of the inner layer 14. The outer layer 15 shown in FIGS. 3 and 4 has an elasticity greater than that of the inner layer 14.

According to these constructions of the grips 13 shown in FIGS. 3 and 4, the outer layers 15 can be easily pushed over the inner layers 14, respectively. Further, particularly in the fourth embodiment shown in FIG. 4, a player can feel a softer tough at the butt circumferential portion of the grip 13 when the gripping the same, and thus can more tightly grip the same.

Figure 8:
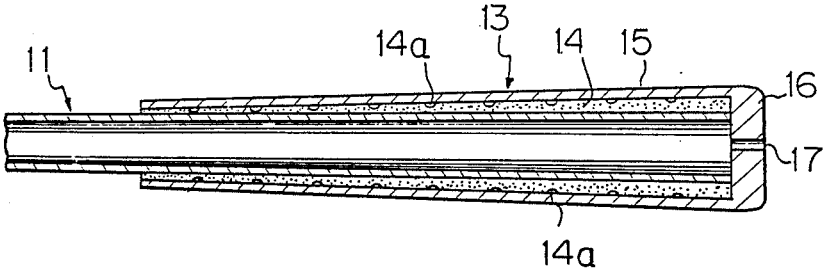
FIGS. 8 to 10 are cross-sectional views, similar to FIG. 2, of the golf clubs each having a grip mounted on a club shaft according to fourth, fifth, and sixth embodiments of the present invention, respectively.
Figure 9:
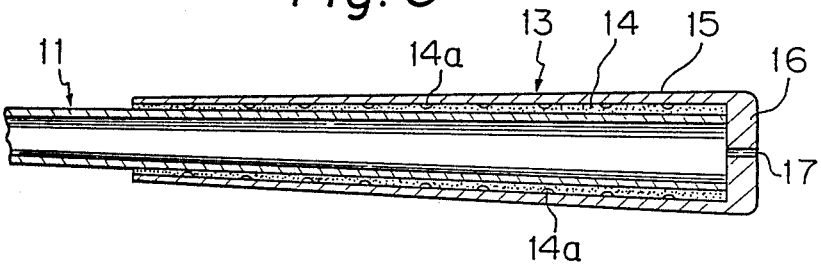
Figure 10:
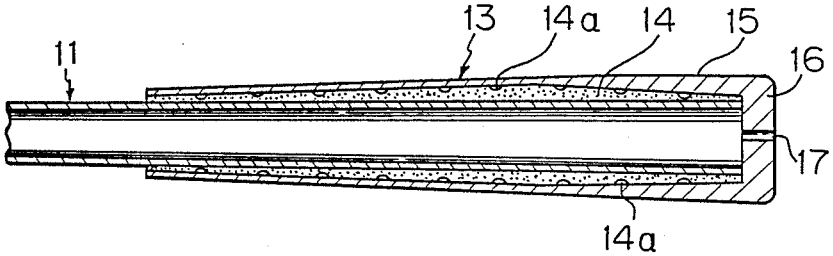

FIGS. 8 to 10 show fourth, fifth and sixth embodiments of the present invention, respectively. In these Figures, constitutional elements the same as in the above-mentioned embodiments bear the same reference numerals. Further, the constructions of the grips 13 shown in FIGS. 8 to 10 are the same as those of grips shown in FIGS. 2, 3 and 4, respectively, except that, in each of the grips 13 shown in FIGS. 8 to 10, a plurality of concavities 14*a* for defining cavities between the inner and outer layers 14 and 15 are positively formed in the outer circumferential surface of the inner layer 14.

According to the construction of each of the grips 13 shown in FIGS. 8 to 10, it is possible to further decrease the weight of the grip 13 and to improve the grip thereof by giving a softer feeling, due to the existence of the positive concavities 14*a*. Further, it becomes possible to more tightly grip the grip 13 mounted on the golf club shaft 11, and thus the swing of the golf club can be stabilized, because the parts of the outer surface of the grip 13 corresponding to the positions of the concavities 14*a* are easily depressed by the gripping force, to give a better grip surface.

Figure 11:
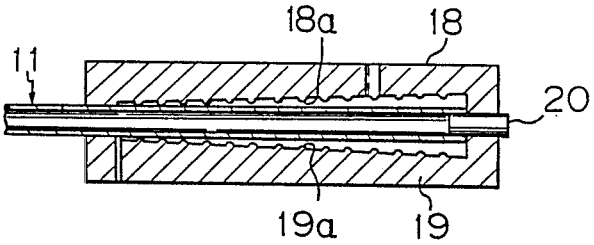
FIG. 11 is a cross-sectional view illustrating a process for forming an inner layer for the grip shown in FIG. 8 on a club shaft.
Figure 12:
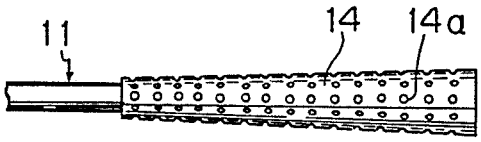
FIG. 12 is a side view of an inner layer formed on the club shaft by means of the process shown in FIG. 11.
Figure 13:
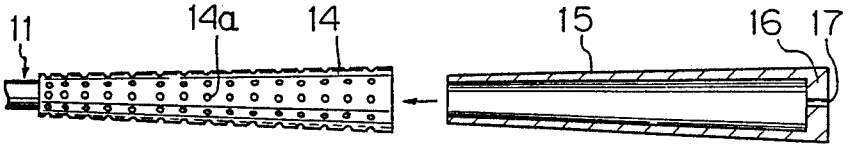
FIG. 13 is a view illustrating a process of fitting the tubular outer layer over the inner layer shown in FIG. 12 for the grip shown in FIG. 8.

FIGS. 11 to 13 illustrate a method of producing the grip 13 shown in FIG. 8, as an example. FIG. 11 illustrates a process for forming an inner layer on the outer circumferential surface of the club shaft 11. In FIG. 11, the butt end of shaft 11 is arranged between a pair of molds 18 and 19 which define therewithin a cavity for defining an outer surface of an inner layer to be formed on the shaft 11. A plug 20 is fitted into the butt end of the shaft 11 and supported between the molds 18 and 19, to stabilize the shaft 11 against the molds 18 and 19. A plurality of projections 18*a* and 19*a* for forming concavities 14*a* in the outer surface of the inner layer 14 is provided on the inner surfaces of the molds 18 and 19, respectively.

A raw material for an inner layer, such as urethane or rubber, is then fed into the cavity of the molds 18 and 19 through holes formed therein. The raw material in the molds 18 and 19 is then subject to foaming by a conventional method, during the molding process. As a result, a porous inner layer 14 having a plurality of concavities 14*a* for the grip 13 shown in FIG. 8 is formed on the shaft 11 and secured thereto, as shown in FIG. 12. Since the inner layer 14 for the grip 13 is directly molded onto the shaft 11, as described above, it is unnecessary to provide a special core for defining the inner surface of the inner layer 14 during the molding. The outer surface of the shaft 11 may be formed with projections or grooves for preventing movement of the molded inner layer 14 along the outer circumferential surface of the shaft 11.

The tubular outer layer 15 for the grip 13 shown in FIG. 8 is made separately from the inner layer 14 by molding, as shown in FIG. 13. Then, the opening end of the outer layer 15 is expanded radially, and the outer layer 15 is then pushed over the inner layer 14 formed on the shaft 11 and is detachably fixed thereto by, for example, a conventional double-face adhesive tape or exfoliative adhesive, provided on the outer circumferential surface of the inner layer 14 before the outer layer 15 is pushed over the inner layer 14.

Although particular embodiments of the present invention have been described, it will be understood, of course, that the present invention is not limited thereto, since modifications can be made by those skilled in the art in the light of the foregoing teaching. For example, the concavities for defining cavities between the inner layer 14 and the outer layer 15 may be formed in the inner surface of the outer layer 15 of the grip 13. Further, the inner layer 14 of the grip 13 may be secured to the shaft 11 after the inner layer 14 is formed separately from the shaft 11.

I claim:

1. A double-layered tubular grip for a golf club shaft having a butt end portion, comprising:

a tubular inner layer made of a porous material having an elasticity, said inner layer being molding on and securely fixed to the outer surface of the butt end portion of said shaft; and a tubular outer layer made of a non-porous material having an elasticity greater than that of said inner layer, a wear-resistant property greater than that of said inner layer, and being formed separately from said inner layer, said outer layer being pushed over said inner layer and detachably fixed thereto after said inner layer is molded on and securely fixed to said outer surface of said butt end portion of said shaft.

2. A grip according to claim 1, wherein said inner layer securely fixed to said shaft has an outer diameter which increases gradually from a tip end thereof to a butt end thereof, and said outer layer detachably fixed to said inner layer has a constant thickness from a tip end thereof to a butt end thereof.

3. A grip according to claim 1, wherein said inner layer securely fixed to said shaft has an outer diameter which increases gradually from a tip end thereof to a middle thereof and remains substantially constant from the middle thereof to a butt end thereof, and said outer layer detachably fixed to said inner layer has an outer diameter which increases gradually from a tip end thereof to a butt end thereof.

4. A grip according to claim 1, wherein said inner layer securely fixed to said shaft has an outer diameter which increases gradually from a tip end thereof to middle thereof and decreases gradually from the middle thereof to a butt end thereof, and said outer layer detachably fixed to said inner layer has an outer diameter which increases gradually from a tip end thereof to a butt end thereof.

5. A grip according to claim 1, wherein said inner and outer layers have a plurality of positive cavities disposed therebetween in order to increase the ease of deformation of said outer layer between each of said cavities and the outer surface of said outer layer while gripping said outer layer.

6. A grip according to claim 1, wherein said inner layer is made of a foam urethane.

7. A grip according to claim 1, wherein said outer layer is made of a vulcanized rubber.

8. A grip according to claim 1, wherein said outer layer is detachably fixed to said inner layer by means of a double-face adhesive tape.

9. A grip according to claim 1, wherein said inner layer is made of a foam rubber.

10. A grip according to claim 1, wherein said outer layer is detachably fixed to said inner layer by means of an exfoliative adhesive.

11. The tubular grip of claim 1, wherein the golf club shaft extends substantially along the entire length of the tubular inner layer and the tubular outer layer.

* * * * *